US010612291B2

(12) United States Patent
Bryant

(10) Patent No.: US 10,612,291 B2
(45) Date of Patent: Apr. 7, 2020

(54) DOOR THRESHOLD ASSEMBLY

(71) Applicant: MJB Wood Group, Inc., Irving, TX (US)

(72) Inventor: David C Bryant, Richmond, IN (US)

(73) Assignee: MJB Wood Group, LLC, Dallas, TX (US)

( * ) Notice: Subject to any disclaimer, the term of this patent is extended or adjusted under 35 U.S.C. 154(b) by 175 days.

(21) Appl. No.: 15/870,724

(22) Filed: Jan. 12, 2018

(65) Prior Publication Data

US 2019/0218849 A1 Jul. 18, 2019

(51) Int. Cl.
*E06B 1/70* (2006.01)

(52) U.S. Cl.
CPC ..... *E06B 1/70* (2013.01)

(58) Field of Classification Search
CPC . E06B 1/70; E06B 7/2316; E06B 7/14; E06B 2001/707
See application file for complete search history.

(56) References Cited

U.S. PATENT DOCUMENTS 3,967,412 A * 7/1976 Governale ..... E06B 1/70 49/468
4,003,162 A * 1/1977 Britt ..... E06B 1/70 49/468
4,287,684 A * 9/1981 McKann ..... E06B 7/22 49/468
4,387,535 A * 6/1983 Corbo ..... E06B 1/70 49/468
4,831,779 A * 5/1989 Kehrli ..... E06B 1/70 49/380
5,136,814 A 8/1992 Headrick
5,230,181 A 7/1993 Geoffrey et al.
5,426,894 A 6/1995 Headrick
5,517,788 A * 5/1996 McGough ..... E06B 1/70 49/467
5,588,266 A * 12/1996 Headrick ..... E06B 1/70 118/504
5,611,173 A * 3/1997 Headrick ..... E06B 1/70 118/504
5,943,825 A * 8/1999 Procton ..... E06B 1/70 49/469
6,345,477 B1 2/2002 Kepler et al.
7,389,611 B2 * 6/2008 Palenske Ci ..... E06B 1/70 49/468
7,472,516 B2 * 1/2009 Pepper ..... E06B 1/70 49/467

(Continued)

OTHER PUBLICATIONS

Homedepot Threshold picture, accessed Dec. 1, 2017.

(Continued)

*Primary Examiner* — Justin B Rephann
(74) *Attorney, Agent, or Firm* — Payam Moradian; Davidson Law Group, ALC

(57) ABSTRACT

Provided is a door threshold assembly for placing below a door comprising: a) a deck configured to be stepped on by a user; b) a base for supporting a first end of the deck positioned on top of the base; c.) a rail positioned on top of the base in proximity to the deck; and d) a seal on top of the base positioned in, between the rail and the deck, and under a portion of the rail, wherein the rail blocks contact with the seal from a top of the threshold at a perpendicular angle.

15 Claims, 4 Drawing Sheets

(56) References Cited

U.S. PATENT DOCUMENTS 7,788,863 B2 * 9/2010 Pepper ..... E06B 3/365 49/467
8,474,189 B1 * 7/2013 Peterson ..... E06B 7/2314 49/479.1
8,490,332 B2 * 7/2013 Van Camp ..... E06B 3/9632 49/468
8,567,128 B2 * 10/2013 Van Camp ..... E06B 1/70 49/468
8,769,874 B1 * 7/2014 Lai ..... E06B 1/70 411/373
8,813,427 B2 * 8/2014 Meeks ..... E06B 1/70 49/467
9,562,387 B2 * 2/2017 Meeks ..... E06B 7/2305
2002/0129557 A1 * 9/2002 Young ..... E06B 1/70 49/468
2004/0200153 A1 * 10/2004 Khanlarian ..... E06B 1/70 49/468
2005/0210754 A1 * 9/2005 Ferrell ..... E06B 1/70 49/468
2006/0053695 A1 * 3/2006 Palenske ..... E06B 1/70 49/468
2006/0112644 A1 * 6/2006 Pepper ..... E06B 1/70 49/468
2006/0174545 A1 * 8/2006 Young ..... E06B 1/70 49/468
2008/0120914 A1 * 5/2008 Fink ..... E06B 1/56 49/469
2008/0229669 A1 * 9/2008 Abdollahzadeh ..... E06B 1/70 49/468
2010/0064590 A1 * 3/2010 Jones ..... E05D 15/0656 49/469
2010/0257789 A1 * 10/2010 Meeks ..... E06B 1/70 49/468
2010/0325982 A1 * 12/2010 Bogenhagen ..... E06B 1/70 52/211
2012/0085037 A1 * 4/2012 Van Camp ..... E06B 1/70 49/468
2013/0047518 A1 * 2/2013 Van Camp ..... E06B 1/70 49/468
2013/0199100 A1 * 8/2013 Van Camp ..... E06B 1/70 49/468
2013/0276376 A1 * 10/2013 Gilbert ..... E06B 1/70 49/469
2015/0052820 A1 * 2/2015 Van Camp ..... E06B 1/70 49/468
2016/0145931 A1 * 5/2016 Meeks ..... E06B 1/70 49/468
2017/0058592 A1 * 3/2017 Meeks ..... E06B 1/70

OTHER PUBLICATIONS

Patent Citations for U.S. Pat. No. 6,345,477, accessed Dec. 17, 2017.
Quanex No. 1, accessed Dec. 18, 2017.
Quanex No. 2, accessed Dec. 18, 2017.
Imperial-Products-5H-Sell-Sheet-web, accessed Dec. 18, 2017.
Imperial-Products-12pg-thresholds-brochure-web, accessed Dec. 18, 2017.

* cited by examiner

DOOR THRESHOLD ASSEMBLY

BACKGROUND SECTION OF THE INVENTION

The installation of a typical door may leave a gap in between the bottom of the door and the ground. A gap is not desirable, particularly when one side of the door is exposed to elements such as water. A door threshold (see e.g. U.S. Pat. No. 6,345,477) is typically attached to the ground below the door to minimize the gap that exists between the door and the ground.

A problem with door thresholds is that they often accumulate water, making the door threshold degrade and become undesirable overtime. Specifically, there is a gap under the rail of a door threshold that is susceptible to accumulation of water. The prior art door thresholds, while resistant to water by definition, are not durable and reliable for long term use. There is a need in the art for a door threshold that is resistant to water and is durable for long term use

BRIEF SUMMARY OF THE INVENTION

Provided is a door threshold assembly for placing below a door comprising: a. a deck configured to be stepped on by a user; b. a base for supporting a first end of the deck positioned on top of the base; c. a rail positioned on top of the base in proximity to the deck; and d. a seal on top of the base positioned in between the rail and the deck, and under a top portion of the rail (portion above the legs), wherein the rail blocks contact with the seal from a top of the threshold at a perpendicular angle. The top portion of the rail can be a lip that extends further than the legs of the rail towards the deck and blocks access from a vertical angle to the seal. The seal van have a vertical portion, and two horizontal portions each connected to one end of the vertical portion. The first end of the deck can have a vertical portion. The deck can have a downwardly slanting portion facing away from the first end, the downwardly slanting portion attached to the top of the vertical portion. In one embodiment, there is no direct contact between the rail and the deck. The top portion of the rail over the seal (lip) can be on a side of the rail facing the deck and can extend over a portion of the deck. The threshold can have a slot below the lip, the slot configured to receive a portion of the seal. The slot can be oriented horizontally. A portion of the seal can be in between a leg of the rail and the top of the base. The deck can incline from a second end towards the first end at a first rate followed by a second rate of incline that is less than the first rate of incline. The seal can have a vertical portion that is placed in between a vertical portion of the deck and a vertical portion of the rail, the seal further having a horizontal portion on top of the vertical portion, the top horizontal positioned in between a lip of the rail and the vertical portion of the deck, the vertical portion having an addition horizontal portion on bottom, the bottom horizontal portion placed in between a leg of the rail and the base, the seal further comprising a compressible cavity for positioning in between, the vertical portion of the deck and a lip of the rail. The bottom horizontal portion of the seal can have an upward protrusion that fills an opening inside the leg of the rail. The vertical portion of the seal can be stiffer than the horizontal portions and the cavity portion of the seal. The seal can comprise a cavity that is compressible. The seal can be made from a dual durometer plastic extrusion. The seal can be made from two different materials. The seal can be made from polypropylene and santoprene.

Provided is a door threshold assembly for placing below a door comprising: a. a deck configured to be stepped on by a user; b. a base for supporting a first end of the deck positioned on top of the base; c. a rail positioned on top of the base in proximity to the deck; and d. a seal on top of the base positioned in between the rail and the deck, the seal made from two separate materials; wherein the seal acts as a barrier against water moving under the rail.

Provided is a door threshold assembly for placing below a door comprising: a. a deck configured to be stepped on by a user; b. a base for supporting a first end of the deck positioned on top of the base; c. a rail positioned on top of the base in proximity to the deck; and d. a seal on top of the base positioned in between the rail and the deck, the seal having a compressible cavity that is configured to be placed in between a lip of the rail and a portion of the base; wherein the seal acts as a barrier against water moving under the rail. The deck can have a first and a second end, wherein the deck inclines from the second end towards the first end at a first rate followed by a second rate of incline that is less than the first rate, the first end of the base having a vertical portion, a downwardly slanting portion pointing towards the second end attached to a top of the vertical portion.

DETAILED DESCRIPTION OF THE INVENTION

Provided is a door threshold assembly for placement under a door. The door threshold is resistant to water, and suitable for long term use.

Figure 1:
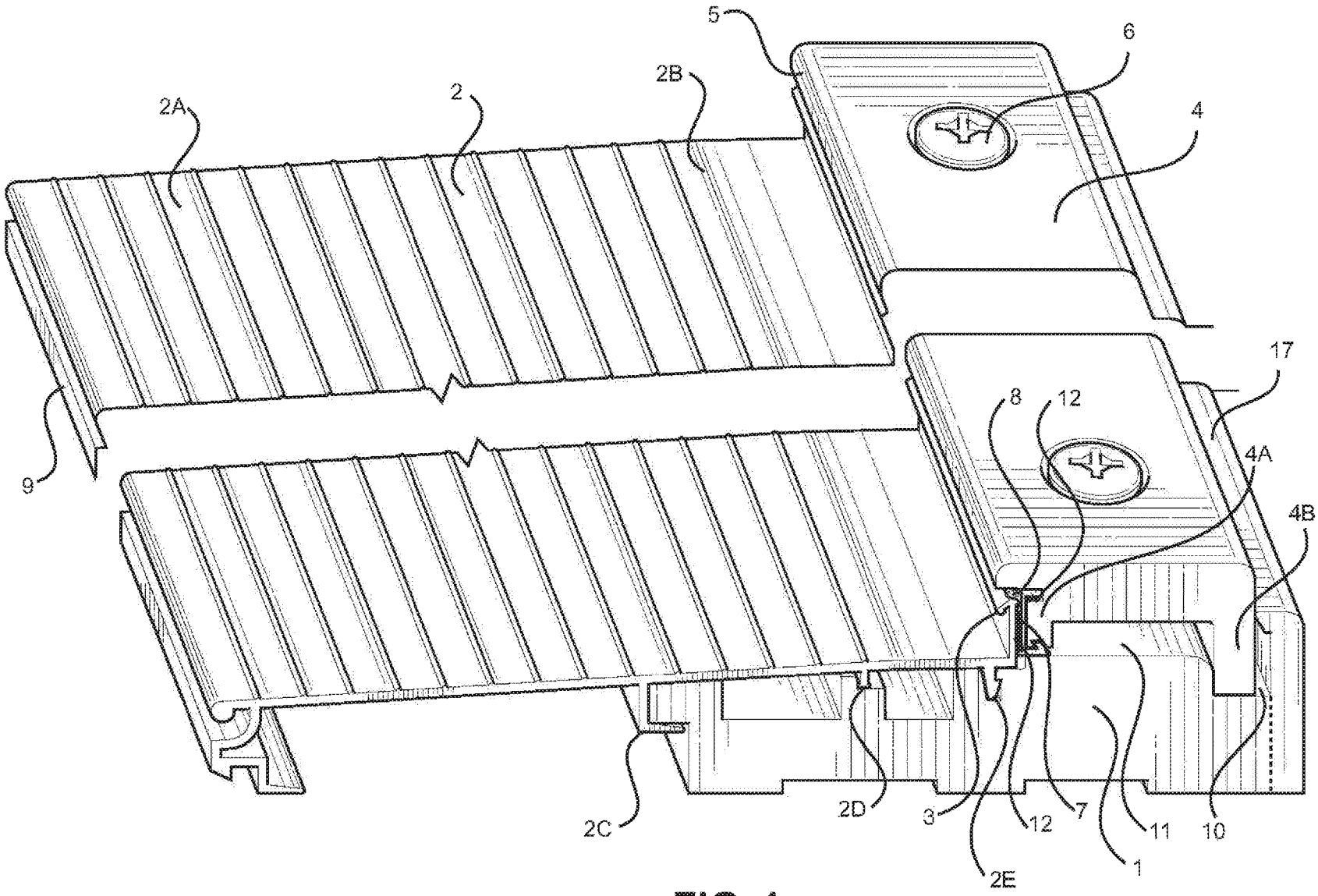
FIG. 1 illustrates a top perspective view of the threshold assembly.

FIG. 1 illustrates the door threshold. The door threshold has a deck 2 that is, configured to be stepped on by a user. Deck 2 can rest on base 1 at the distal end 2B and rest on the ground at the proximal (front) end 9. Deck 2 can have two different inclines. The first portion 2A can have an increasing incline (such as an angle of 5 degrees to 1 degrees, such as 4 degrees), followed by a shorter section with a smaller decline (such as an angle of 2 to 0 degrees, such as 1 degree). In other words, the deck starting from front end 9 increases in height as it gets closer to base 1, and then at the last portion of the deck 2, the increase in height becomes more, gradual.

A portion of deck 2 can rest on base 1. Base 1 can be a single piece where nose 17 is extruded together with the rest of base 1, or made from two pieces by attachment of base 1 to nose 17. The broken lines in FIG. 1 illustrate the possibility of having the base 1 made from one or two pieces. The bottom of deck 2 can have a U-shaped receiver 2C for receiving a portion of the base 1, and supports 2D and 2E for allowing deck 2 to rest on top of base 1. The end of deck 2 can terminate in a vertical portion 12. The vertical portion 12 can have a drip edge 3, which can be a downwardly slanting portion oriented towards the front end 9. The downwardly slanting portion 3 can be on top of the vertical portion 12.

The proximal portion of base 1 can support deck 2. The distal portion of base 1 can support rail 4. Base 1 can have a groove 10 for allowing one leg of rail 4 to sit inside of the groove 10. Leg 4B of the rail 4 can be placed inside of the groove 10. The other leg of rail 4 (Rail 4A) can be placed closer to the center of base 1. Rail 4A can be shorter than the leg 4B in height. There can be a gap 11 formed in between the two legs of rail 4 on top of base 1. It is desirable to keep water out of the gap 11. As illustrated in FIG. 1, deck 2 terminates at vertical portion 12, and does not directly contact rail 4 or extend below rail 4.

Figure 2:
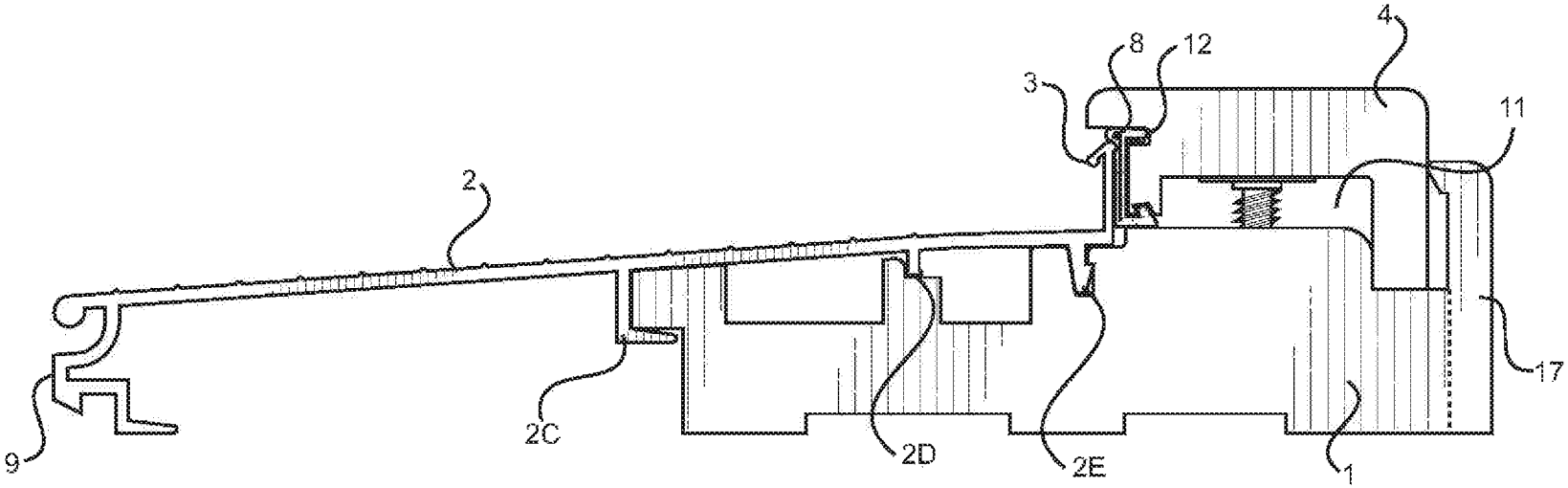
FIG. 2 illustrates a side view of the threshold assembly.

The side of rail 4 facing deck 2 can have a lip 5 that extends in a horizontal manner over the vertical portion 12 of the deck 2, and can further extend partially or completely to be over the drip edge 3. Seal 7 is configured to be placed in between the deck 2 and the rail 4. In this configuration, seal 7 is not exposed and protected by deck 2 from the front and rail 4 from the top to increase reliability and durability of the seal 7. This configuration also allows the seal 7 to be easily installed, and makes the threshold assembly more water resistant FIG. 2 illustrates a side view of the threshold assembly. Base 1 is configured to rest on a surface, typically the floor surface below a door. Deck 2 is put on a portion of the upper surface of base 1. Deck 2 can rest on the floor at one end 9 with a vertically extending pedestal. At the other end, deck 2 rests on the base 1. The height of base 1 is higher than the front end 9 of deck 2, resulting in an incline of deck 2. Deck 2 inclines when moving from front side 9 to base 1. The incline of deck 2 varies. In a first portion, which covers the majority of deck 2, the deck inclines at a higher rate. Deck 2 can be supported on base 1 with one or more of supports 2D, 2E. The end of deck 2 that inclines, at a lower rate has a vertical portion 12, on top of which is a slanting portion, drip edge 3. Drip edge 3 slants down at an angle of about 30 to about 60 degrees towards front end 9 of deck 2.

As illustrated, Deck 2 occupies about 50 to about 65% of the top surface of base 1, which typically has a length that matches the length of the floor under a door from one side of the door frame to another side of the door frame. In other configurations, Deck 2 can cover 0.25, 0.50, or a smaller portion of the base 1. Rail 4 is placed on top of base 1 next to the vertical portion 12 of deck 2. Leg 4B of rail 4 sits inside groove 10 of base 1. Leg 4A of rail 4 runs parallel to vertical portion 12. Seal 7 is placed in an upright position in between vertical portion 12 and leg 4B. Leg 4B can rest on and push down a lower horizontal portion of seal 7.

Figure 5:
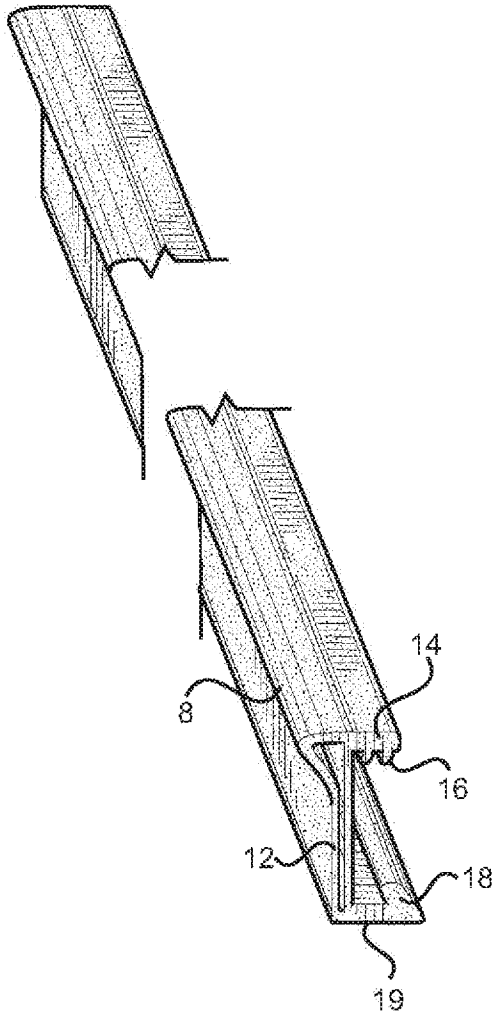
FIG. 5 illustrates the seal before placement in the threshold assembly.

As illustrated in FIG. 5, Seal 7 can have a top horizontal portion 15 and a lower horizontal portion 19 attached to a vertical portion 14. The top horizontal portion of seal 7 fits onto a slot (dam) 13 below the rail lip 5. The top horizontal portion 14 that fits into slot 13 can have one or more ridges 16 that extend down and provide for tighter grip between seal 7 and rail 4. The seal can have a cavity 8 on the side of the vertical portion 12, and opposite to the sides where the horizontal portions of the seal are placed. The cavity 8 can come out from top of the vertical portion 12 in a horizontal fashion, and then curve in a backward and downward fashion to meet the bottom of the vertical portion 12. The ends of cavity 8 can be attached to the bottom and the top end of the vertical portion 12 of the seal 7. The pliable material that forms cavity 8 can protrude forward and fill the gap between the top of vertical section of the deck 2 and the bottom of the lip 5. The compression of the seal 7 to the vertical portion on the deck forces the articulation that seals at the top and inside of the vertical portion 12 of the deck 2. The cavity 7 can have a single hollow space inside (void) running along seal 7. The cavity 7 can get compressed when the seal 7 is placed in position, providing for additional grip and a tighter fit. The vertical section 14 of seal 7 can have a lower horizontal portion 19 that moves from the vertical portion away from deck 2, and can be positioned in between leg 4A of rail 4 and base 1. Seal 7 seals the gap between deck 2 and rail 4, as well as in between rail 4 and base 1. Seal 7 can also have a hump 18 that comes up the horizontal portion 19 and fits into a cavity/gap on the bottom of leg 4*a* of rail 4.

As illustrated in FIG. 2, seal 7 is protected from wear and tear. Seal 7 is blocked from the top by lip 5. When a user steps on the threshold assembly, the user does not touch the seal 7. The seal 7 is also positioned behind vertical portion 12 of deck 2, further limiting exposure. Top of the seal 7 (such as less than 25%) extends over vertical portion 12 to provide for a proper fit, and remains on top of vertical portion 12 without extending to below of the vertical portion 12 on the front side.

Figure 3:
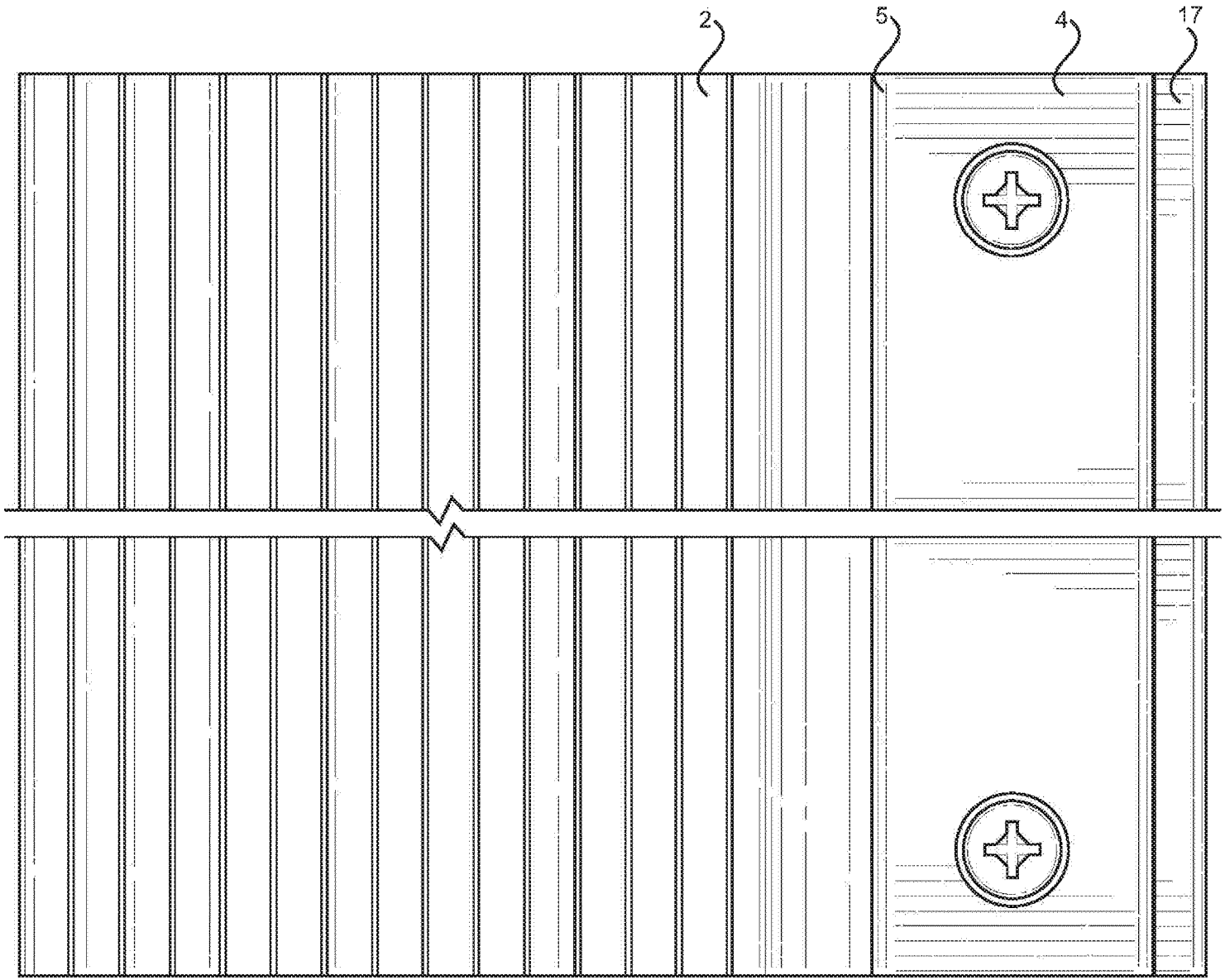
FIG. 3 illustrates a top view of the threshold assembly.

FIG. 3 illustrates a top view of the door threshold. Illustrated in the view are deck 2, rail 4, and base 1. Seal 7 and vertical portion 12 of deck 2 are not visible in this view since Rail lip 5 extends over them. Seal 7 is protected from the top by lip 5 of rail 4 from everyday wear and tear.

Figure 4:
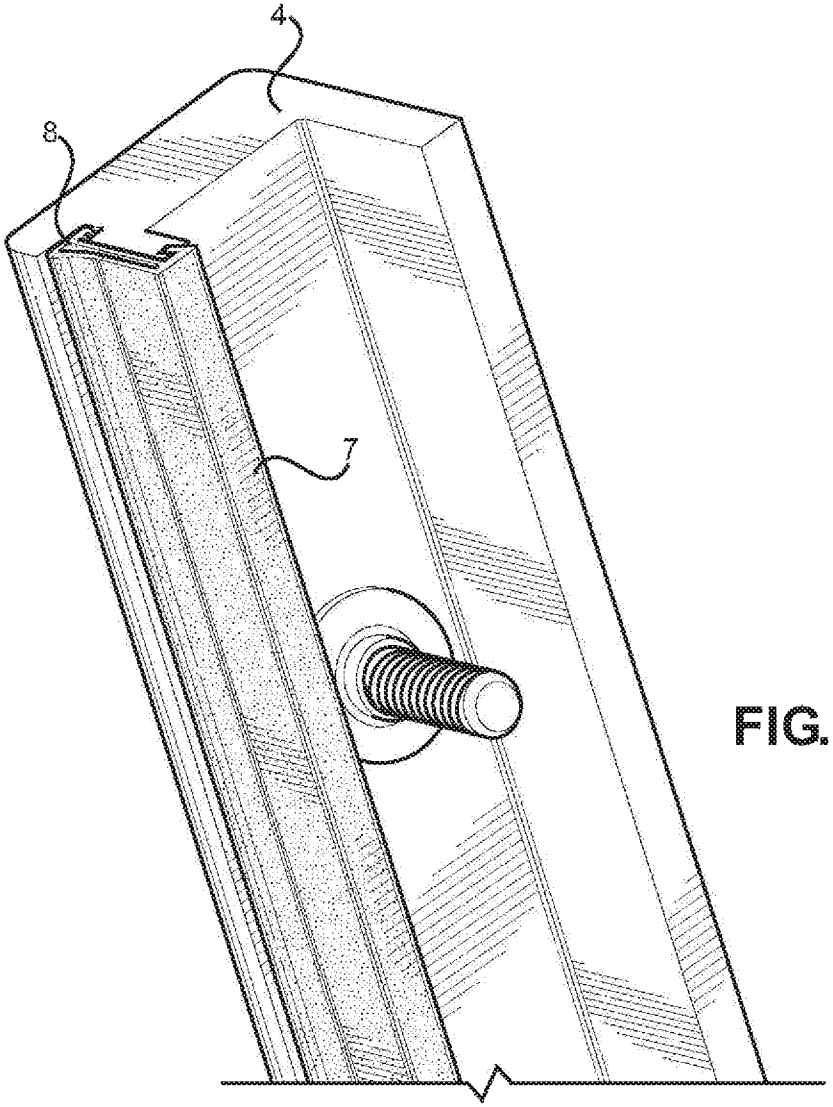
FIG. 4 illustrates a bottom perspective view of the rail with the seal attached thereto.

FIG. 4 illustrates the lower side of rail 4 with seal 7 attached thereto. Fastener 6 goes through an opening on top of rail 4, and is configured for attaching rail 4 to base 1. The height of rail 4 can be adjustable.

Deck 2 can be made from a metal, such as aluminum. Rail 4 can be made from cellular PVC. Base 1 can be made from Cellular PVC (Polyvinyl chloride). The seal 7 can be made from a dual durometer plastic extrusion, which is a co-extrusion process that fuses two materials of different physical properties into one uniform or consistent cross section. A combination of a rigid material, for strength, with a soft or flexible material, for function, can be used. The rigid material (the straight vertical member and the horizontal members) can be made of glass or mineral filled polypropylene. The pliable material (the cavity and tension fins) can be made, of santoprene. Other suitable materials can be used for each of the components of the assembly. The seal 7 can stay in place as a result of a tension fit. The threshold assembly can be sealed with caulking.

REFERENCES

1. Base
2. Deck
2A. Proximal end of deck (away from rail 4)
2B. Distal end of deck
2C. vertical section
2D. Support
2E. Support
3. Drip edge of deck
4. Rail
4A. Rail Leg
4B. Rail Leg
5. Rail Lip
6. Fastener
7. Seal (articulating seal)
8. Seal cavity
9. Front end of the deck
10. groove
11. gap
12. Vertical portion of the deck
13. Slot
14. Vertical portion of the seal
15. Top horizontal portion of the seal
16. Seal Ridge

17. Nose of base
18. Bump on seal
19. Lower Horizontal portion

What is claimed is:

1. A door threshold assembly for placing below a door comprising:

a. a deck configured to be stepped on by a user, the deck having a first end and a second end, the first end having a vertical portion;

b a base for supporting the first end of the deck, the first end of the deck positioned on top of the base;

c. a rail positioned on top of the base in proximity to the first end of the deck, the rail having a first leg and a lip, the lip extending further than the first leg towards the first end of the deck; and d. a seal on top of the base and under a top portion of the rail positioned behind the first end of the deck, and in front of the first leg of the rail, a front of the deck is defined in relation to the second end of the deck, the seal preventing direct contact between the first leg of the rail and the deck, wherein the lip of the rail blocks contact with the seal from a top of the threshold at a perpendicular angle with respect to a floor.

2. The door threshold of claim 1, wherein the seal has a vertical portion, and two horizontal portions each connected to one end of the vertical portion.

3. The door threshold of claim 1, wherein the deck has a downwardly slanting portion facing towards the second end of the deck, the downwardly slanting portion attached to the top of the vertical portion.

4. The door threshold of claim 1, wherein the lip is on a side of the rail facing the deck and extends over a portion of the deck.

5. The door threshold of claim 4, further comprising a slot below the lip, the slot configured to receive a portion of the seal.

6. The door threshold of claim 5, wherein the slot is oriented horizontally.

7. The door threshold of claim 1, wherein a portion of the seal is in between the first leg of the rail and the top of the base.

8. The door threshold of claim 1, wherein the deck inclines from the second end towards the first end at a first rate followed by a second rate of incline that is less than the first rate of incline.

9. The door threshold of claim 1, wherein the seal has a vertical portion that is placed in between the vertical portion of the deck and a vertical portion of the rail, the seal further having a horizontal portion on top of the vertical portion, the vertical portion of the seal having an additional horizontal portion on bottom, the bottom horizontal portion placed in between the first leg of the rail and the base, the seal further comprising a compressible cavity for positioning in between the vertical, portion of the deck and the lip of the rail.

10. The door threshold of claim 9, wherein the bottom horizontal portion of the seal has an upward protrusion that fills an opening inside the leg of the rail.

11. The door threshold of claim 9, wherein the vertical portion of the seal is stiffer than the horizontal portions and the compressible cavity portion of the seal.

12. The door threshold of claim 1, wherein the seal comprises a cavity that is compressible.

13. The door threshold of claim 1, wherein the seal is made from a dual durometer plastic extrusion.

14. The door threshold of claim 13, wherein the seal is made from polypropylene and santoprene.

15. The door threshold of claim 1, wherein the seal is made from two different materials.

* * * * *